United States Patent [19]

Hodén et al.

[11] Patent Number: 4,831,713

[45] Date of Patent: May 23, 1989

[54] ARRANGEMENT FOR REMOVING WRAPPING WIRE FROM BALES

[75] Inventors: Ebbe Hodén, Bergåsa, Sweden; Erich Guggenberger, Mont Blanc, Switzerland

[73] Assignee: Sunds Defibrator AB, Sundsvall, Sweden

[21] Appl. No.: 203,450

[22] PCT Filed: Dec. 11, 1986

[86] PCT No.: PCT/SE86/00567

§ 371 Date: Jun. 8, 1988

§ 102(e) Date: Jun. 8, 1988

[87] PCT Pub. No.: WO87/03556

PCT Pub. Date: Jun. 18, 1987

[30] Foreign Application Priority Data

Dec. 12, 1985 [SE] Sweden ..... 8505871

[51] Int. Cl.[4] ..... B26D 9/00

[52] U.S. Cl. ..... 29/564.3; 83/301; 83/349; 83/404; 83/909; 83/923

[58] Field of Search ..... 83/404, 409, 925 R, 83/349, 301, 923; 29/564, 564.3

[56] References Cited

U.S. PATENT DOCUMENTS

| | | | |
|---|---|---|---|
| 3,513,522 | 5/1970 | Thomson | 83/909 X |
| 3,521,347 | 7/1970 | Bentley | 83/909 |
| 4,244,251 | 1/1981 | Iwao et al. | 83/349 |
| 4,561,928 | 12/1985 | Malthouse | 83/349 |

FOREIGN PATENT DOCUMENTS

| | | |
|---|---|---|
| 2003006 | 12/1971 | Fed. Rep. of Germany . |
| 2100869 | 7/1972 | Fed. Rep. of Germany . |
| 2500948 | 7/1976 | Fed. Rep. of Germany . |
| 2417436 | 9/1979 | France . |
| 394098 | 6/1977 | Sweden . |
| 435608 | 10/1984 | Sweden . |

*Primary Examiner*—Frank T. Yost
*Assistant Examiner*—Y. C. Lin
*Attorney, Agent, or Firm*—Fleit, Jacobson, Cohn & Price

[57] ABSTRACT

An arrangement for removing and separating into pieces wrapping wire (3) encircling a bale (2) or like package in individual, closed loops includes a first wire clipping device (6) for severing the wire in each separate loop at a location (29), to form a wire length; a second wire clipping device (14, 16, 17) for dividing the wire length into smaller pieces; and feed means (10, 12'16, 18) for advancing the wire length to the second wire clipping device. The latter device (14, 16, 17) comprises at least one cutting bit (16) projecting radially outwards from a motor-driven rotor (14) and whose cutting edge generates a cylindrical surface, and further comprises a stationary counter cutting bit (17). The feed means includes a part-cylindrical guide surface (18) which co-operates with the cutting edge to advance a wire length introduced between the guide surface and the rotor (14) to the counter cutting bit.

3 Claims, 3 Drawing Sheets

ARRANGEMENT FOR REMOVING WRAPPING WIRE FROM BALES

TECHNICAL FIELD

The present invention relates to an arrangement for removing and separating into pieces wrapping wire that encircles a bale or like package in individual, closed loops, said arrangement being of the kind which includes a first wire clipping device for severing the wire in each separate loop of wrapping wire at a given location thereon, to form a wire length; a second wire clipping device for dividing the wire length into smaller pieces or slugs; and feed means for advancing the wire length to the second wire clipping device, said second wire clipping device comprising at least one cutting bit which projects radially outwards from a motor-driven rotor and the cutting edge of which generates a substantially cylindrical surface as the rotor rotates, and further comprises a stationary counter cutting-bit.

BACKGROUND PRIOR ART

An arrangement of the aforedescribed kind is described and illustrated in DE-B-21 00 869, this known arrangement being intended for the removal of wrapping wire used to hold together rolled metal strip that has been rolled-up into a cylinder form. This known arrangement is relatively complicated, since it requires the provision of a pair of feed rollers with associated drive means, for advancing the wrapping wire to the location of the second clipping device. One of the rollers of the pair of feed rollers must be capable of considerable movement towards and away from the other roller of said pair, in order to ensure that one free end of the wire that is formed when clipping the wire loop encircling the cylinder of rolled metal strip by means of the first clipping device is captured by the roller pair.

SUMMARY OF THE INVENTION

One object of the present invention is to provide a novel and advantageous arrangement for removing wrapping wires or like ties in which the provision of feed rollers and associated drive means for advancing wire lengths to the second clipping device is no longer necessary.

To this end it is proposed in accordance with the invention that the feed means of a wrapping-wire removal arrangement of the aforesaid kind includes a part-cylindrical guide surface which is located upstream of the counter cutting-bit and outwardly of and parallel with the surface generated by the cutting-bit of the rotor, and that the arrangement includes a means for introducing one end of said wire length between said guide surface and the rotor, the distance between the guide surface and the surface generated by the cutting-bit of the rotor being so much smaller than the thickness of the wire that when the rotor rotates the cutting-bit thereof, upon passage of the cutting-bit along the guide surface, bites into a wire length introduced between the guide surface and the rotor and dogs or likewise entrains the wire length to the location of the counter cutting-bit, with said wire length sliding against said guide surface, where said wire length is severed. This arrangement beneficially obviates the need of providing feed rollers between the wire clipping devices, therewith rendering the wire removing arrangement less complicated and less expensive.

Further characteristic features of the invention and advantages afforded thereby will be evident from the following claims and from the description made hereinafter with reference to an exemplifying embodiment of an arrangement intended for removing steel wrapping wire from paper-pulp bales while the bales rest on a conveyor.

DESCRIPTION OF EMBODIMENTS AT PRESENT PREFERRED

Figure 1:
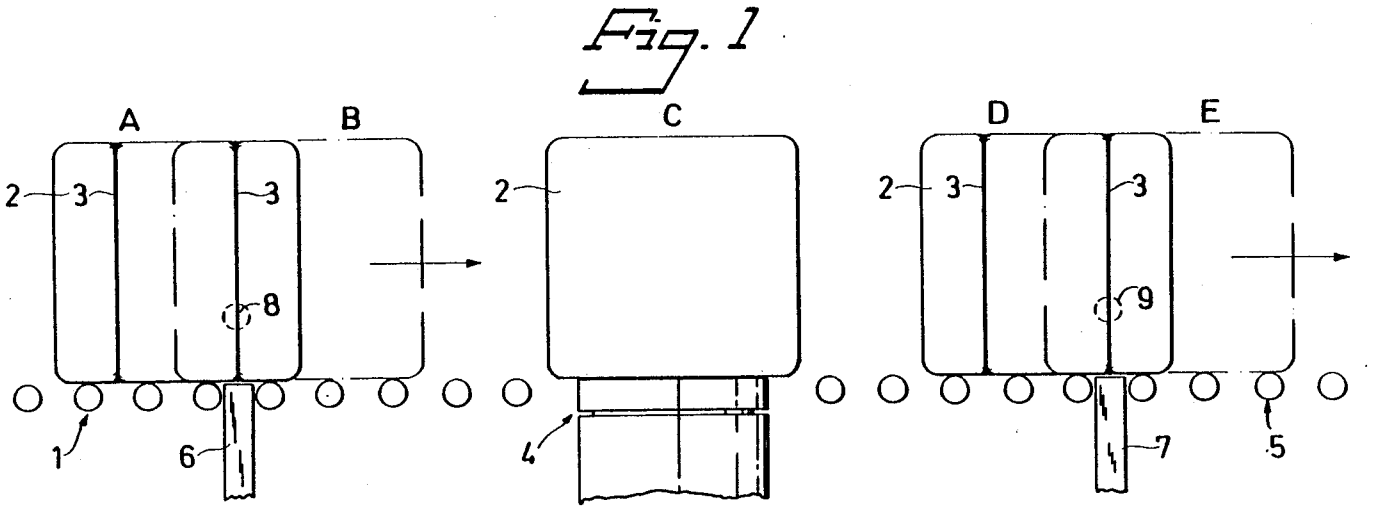
FIG. 1 is a schematic illustration of an arrangement of apparatus according to the invention, as seen at right angles to the direction of bale transportation.

The arrangement illustrated in FIGS. 1–6 of the accompanying drawings comprises a first roller path 1 which carries a bale 2 of paper pulp, around which there is wrapped four steel wires 3 in mutually parallel pairs, the wires 3 of one pair extending at right angles to the wires 3 of the other pair. The bale 2 is placed on the first roller path 1 in position A, as shown with the bale drawn in full lines in the Figure, and in position B, as shown with the bale drawn in chain lines, this latter bale partially overlapping the bale shown in full lines. The arrangement also includes a turntable 4, on which a bale 2 is placed in position C, and a second roller path 5, which carries a bale 2 placed in position D, in accordance with the full line figure which shows the bale 2, and in position E, in accordance with the figure drawn in chain lines, this latter figure partially overlapping the figure drawn in full lines.

Figure 2:
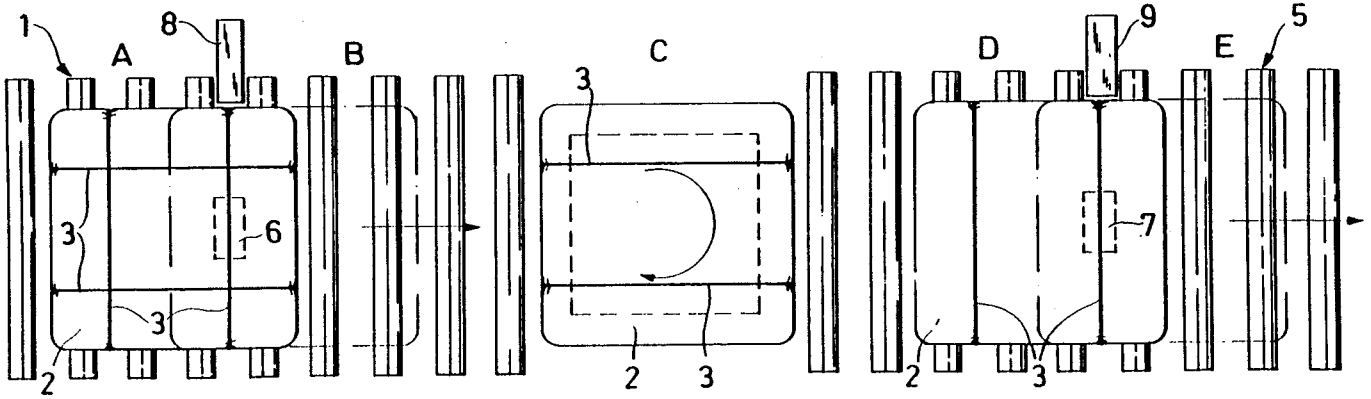
FIG. 2 is a top plan view of the arrangement illustrated in FIG. 1.

The roller paths 1, 5 are illustrated schematically in the drawings and comprise mutually parallel, driven rollers, the upper surfaces of which rollers lie in one and the same plane and the common transport direction of which is arrowed in FIGS. 1 and 2 of the drawings. The turntable 4 is also illustrated schematically in the drawings and comprises an upper part which is rotatable about a vertical axis and which is provided with driving roller means, not shown in the drawings, by means of which the bale 2 can be moved in two mutually perpendicular directions. The bale 2 is driven in one of said directions when moved from the first roller path 1 to the turntable 4, and in the other of said directions when moved from the turntable 4 to the second roller path 5. In between these movements the turntable 4 has been rotated through 90°, so that the steel wires 3, which in positions A and B are located in the transporting direction of the roller path 1, are not orientated in positions D and E, so as to be at right angles to the transporting direction of the roller path 5.

Beneath the first roller path 1 there is arranged a first wire clipping device 6, which is vertically moveable so that it can be brought in between two mutually adjacent rollers of the first roller path 1. When the bale 2 is located in the position A, the forwardly lying wrapping wire 3, which is at right angles to the transporting direction, is located immediately above the first wire clipping device 6 in the first roller path 1, said device being illustrated symbolically in FIGS. 1 and 2. The forward wrapping wire 3 is severed by bringing the wire clipping device 6 into contact with the under surface of the bale 2. When the bale 2 is located in position B, its rearwardly lying wrapping wire is located above the first wire clipping device 6 and is severed in a similar manner. The wrapping wires 3 are moved, with the aid of an electromagnet 10, down from the under side of the bale 2 and into a combination arrangement of a combined wire feed means and second wire clipping device 11, illustrated in FIG. 4, by means of which the wire 3 is removed from the bale 2 and divided into small pieces or slugs.

Figure 4:
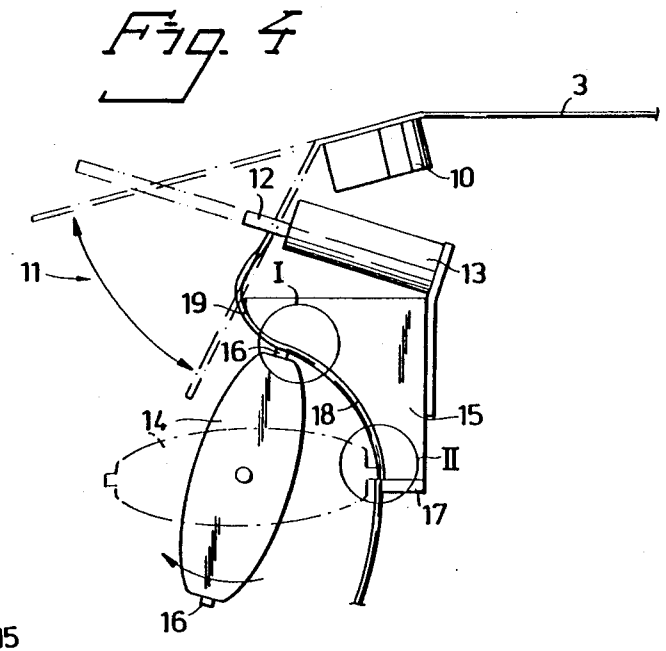
FIG. 4 illustrates schematically a wire feeding and wire dividing device arranged in the proximity of the wire clipping device illustrated in FIG. 3.
Figure 3:
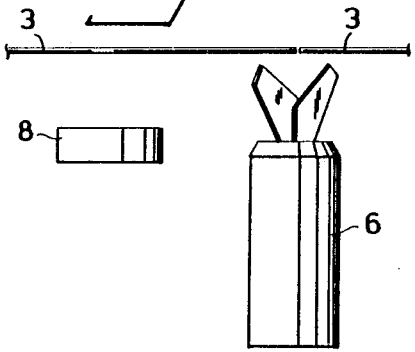
FIG. 3 illustrates part of a wire clipping device located beneath a roller path.
Figure 5:
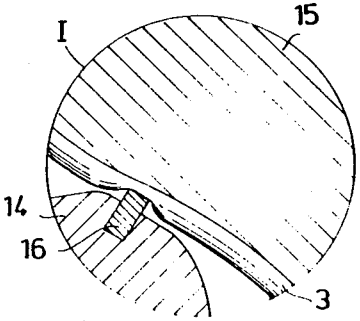
FIG. 5 is an enlarged cross-sectional view of the part I illustrated in FIG. 4.
Figure 6:
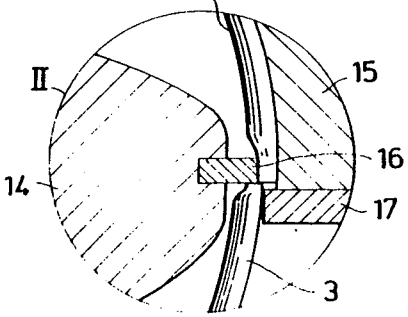
FIG. 6 is an enlarged cross-sectional view of the part II illustrated in FIG. 4.

The combined wire feed and wire clipping arrangement 11 incorporates a capturing device 12 which can be displaced outwardly to an outer position, illustrated in broken lines in FIG. 4, in which it captures the severed wire 3, which is also illustrated in broken lines in this position. The wire is then drawn into an inner position in the arrangement, with the aid of a pneumatic piston-cylinder device 13, the wire 3 being bent down at the same time to the lower position shown in broken lines in FIG. 4. In this position, the outwardly projecting end of the wire 3 is captured by a rotor 14 forming part of the second wire clipping device and pressed in towards a part-cylindrical guide surface 18 on a stator 15 and drawn along the guide surface, or stator, from the position referenced I to the position referenced II in FIG. 4.

The rotor 14, which is driven by a motor not shown in FIG. 4, has provided thereon two diametrically opposed cutting bits 16 which project radially from the rotor and the cutting edges of which generate a substantially cylindrical surface which is generally concentrical with the part-cylindrical guide surface 18. The distance between the cylindrical surface generated by the cutting edges and the guide surface 18 is smaller than the thickness of the wire to be cut, so that as the rotor 14 rotates the cutting bits located thereon will bite into the wire 3 caught between the guide surface and the rotor during passage of the bits along the guide surface and therewith dog or likewise entrain the wire with said wire sliding against said guide surface. The cutting bits 16 thus form dogging means. In the position II the respective cutting bits 16 pass a stationary counter cutting-bit 17 located at the outlet end of the stator 15, where the wire 3 is severed between the cutting bits 16 and the counter cutting-bit 17. The length of wire 3 thus severed corresponds substantially to the distance through which respective cutting edges have moved along the stator 15 from the time at which a cutting bit 16 has engaged the wire to the point of time at which said cutting bit 16 passes the counter cutting-bit 17.

The wire stator 15 is arranged so that the severed wire 3 projects outwardly over the stator 15 against which the wire is bent down by means of the capturing arrangement 12. Located at the inlet end of the first part-cylindrical surface 18, remote from the counter cutting-bit 17, is a second cylindrical surface 19 which is curved in a direction opposite to the first part-cylindrical surface 18 and adjoins said surface at said inlet end. As the rotor 14 rotates, the end of the wire is bent around the second part-cylindrical surface 19 which is is drawn by the cutting edges of the cutting bits 16 forwardly along the first cylindrical surface up to the counter cutting-bit 17 at the outlet end of the stator 15 where the wire 3 is severed. As the wire 3 has reached and is fed along the stator 15, the current supply to the electromagnet 10 is switched off.

A further wire clipping device 7, also illustrated symbolically in FIGS. 1 and 2 and corresponding with the aforedescribed wire clipping device is arranged beneath the second roller path 5 and is active between two rollers of the second roller path 5, for removal of the remaining wrapping wires 3 of the bale 2 in positions D and E, in a manner similar to removal of the wire in the positions A and B.

The position of the wire at locations A and B on the first roller path 1 and the wire positions at locations D and E on the second roller path 5 are determined with the aid of wire sensors 8, 9, which are located at each of said wire clipping devices 6, 7. When the bale 2 moves along respective roller paths 1, 5 and the forwardly located wrapping wire 3, as seen in the direction of transportation, which is detected by the wire sensor 8, 9, the drive to the roller path 1, 5 is disengaged, wherewith the forward wire 3 is located above a respective wire clipping device 6, 7. When the bale 2 is again set in motion, the drive is disengaged when the rearwardly lying wire has been detected by the wire sensor 8, 9 whereupon the rear wire is located above a respective wire clipping device 6, 7.

Figure 7:
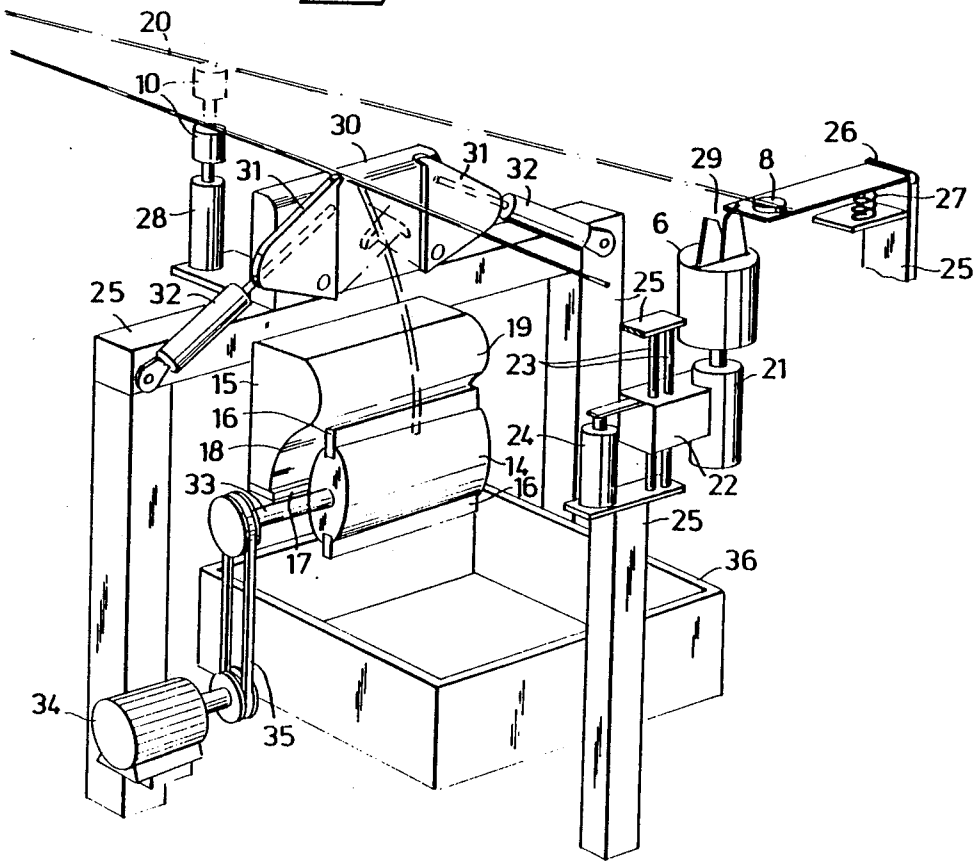
FIG. 7 illustrates a preferred embodiment of the arrangement according to the invention in more detail.

The preferred embodiment illustrated in FIG. 7 is constructed in principally the same manner as the arrangement described above with reference to FIGS. 3–6. The reference numeral 20 in FIG. 7 identifies a horizontal lower part of a magnetic metal wire which is shown in broken lines and which is wound in an endless loop around a bale (not shown) resting on a horizontal roller path or some other form of conveyor (also not shown) which enables the part 20 to be reached from beneath. The reference numeral 6 identifies conventional shears driven by a pneumatic piston-cylinder device 21. The shears 6 and the piston-cylinder device 21 are securely mounted on a slide 22, which can be displaced axially along vertical guides 23 by means of a further pneumatic piston-cylinder device 24. The piston-cylinder device 24 and the guides 23 are carried by a machine frame structure 25, and the piston-cylinder device 24 is operative in moving the shears 6 between (a) an upper position, in which each of the shear blades is located on a respective side of the wire part 20, so as to sever said wire part upon activation of the piston-cylinder device 21, and (b) a lower position in which the shears are located out of the path of the bales located on the conveyor.

Also incorporated in the arrangement illustrated in FIG. 7 is a sensor 8, which is mounted on an arm which extends in the transporting direction of the conveyor and which is hinged at one end to the frame structure 25, by means of a hinge 26. A thrust spring 27 acting between the frame structure and the arm urges the arm into contact with the under surface of the bales advanced on the conveyor. The sensor is adapted to detect the presence of magnetic metal wires and upon detecting such a wire is operative in initiating a sequence of operations in which the conveyor is stopped, the shears 6 are moved upwardly to their raised position by means of the piston-cylinder device 24, the piston-cylinder device 21 is activated to effect severing of the wire loop, and the shears 6 are again lowered to their lower position.

The electromagnet 10 of the illustrated embodiment is carried on the outer end of the piston rod of a pneumatic piston-cylinder device 28, which in turn is carried by the frame structure 25. The magnet 10 is arranged for movement between an upper position, shown in broken lines, in which it is located in the close proximity of or in physical contact with the wire part 20, and a lower position, shown in full lines, in which it is moved out of the path of the bales located on the conveyor. As the magnet 10 moves from its upper to its lower position, it entrains, or pulls, the left-hand part of the wire part 20 (as seen in FIG. 7) severed at 29, such as to bring this severed wire part into abutment with a support 30 carried by the frame structure 25. The support 30 has journalled thereon two wire-capturing arms 31, each of which is arranged for rotational movement between the open position shown in full lines, in which the wire end can pass freely in between the arms, and the holding-down position shown in broken lines, in which the captured part of said wire end is bent down in such a manner that the extremity of said captured wire end is located in the space between the rotor 14 of the second wire clipping device 14–18 and the guide surface 18 as illustrated in chain lines in the Figure, said rotational movement of the arms 31 being effected by means of pneumatic piston-cylinder devices 32 acting between the arms and the frame structure 25. The shaft 33 of the rotor 14 has been shown in FIG. 7, but not the journal bearings of the rotor. The rotor shaft 33 is driven by an electric motor 34, over a V-belt transmission 35. When the wire-end reaches the position shown in chain lines, the wire is dogged by the rotor cutting-bits 16 in the manner described with reference to the FIG. 1–6 embodiment, and is divided into relatively short pieces through the mutual co-action of the cutting bits 16 and the counter cutting-bit 17. The severed pieces of wire, or slugs, are collected in a container illustrated at 36. As with the aforesaid second part-cylindrical surface 19 of the FIG. 1–6 embodiment, the upper surface of the support 30 is rounded, to facilitate passage of the wire length formed by severing wire 3 at 29 to the second wire clipping device 14–18. If desired, the arms 31 can be held in the holding-down position, shown in broken lines, until the whole of the wire length has been cut up. The rotor 14 may be driven continuously or intermittently, solely in conjunction with dividing wire lengths into smaller pieces.

It will be understood that the described and illustrated embodiments are not restrictive of the scope of the invention, and that modifications can be made within the scope of the invention as defined in the following claims.

We claim:

1. An arrangement for removing and dividing into pieces wrapping wire (3) that encircles a bale or like package in individual, closed loops, said arrangement being of the kind which includes a first wire clipping device (6) for severing the wire in each separate loop of wrapping wire at a location (29), to form a wire length, a second wire clipping device (14, 16, 17) for dividing the wire length into smaller pieces, and feed means (10, 12, 16, 18) for advancing the wire length to the second wire clipping device, said second wire clipping device (14, 16, 17) comprising at least one cutting bit (16) which projects radically outwards from a motor-driven rotor (14) and the cutting edge of which generates a substantially cylindrical surface as the rotor rotates, and which further comprises a stationary counter cutting-bit (17) characterized in that the feed means includes a part-cylindrical guide surface (18) which is located upstream of the counter cutting-bit (17) and is outwardly of and parallel with the surface generated by the cutting bit (16) of the rotor (14), and that the arrangement includes means (10, 12, 13) for introducing one end of said wire length between said guide surface and the rotor (14), the distance between the guide surface (18) and the surface generated by the cutting bit (16) of the rotor being so much smaller than the thickness of the wire that when the rotor rotates the cutting bit (16) thereof, upon passage of said cutting bit along the guide surface, bites into a wire length introduced between the guide surface and the rotor and dogs or likewise entrains the wire length to the location of the counter cutting-bit (17), with said wire length sliding against said guide surface, where said wire length is severed.

2. An arrangement according to claim 1, characterized in that the feed means (10, 12–16, 18) includes bending means (10, 12, 13) for bending an end portion of the wire length still located around the bale (2) from one position in which said end portion follows one side of the bale, to another position in which the extremity of said end portion is located between the rotor (14) and the guide surface (18).

3. An arrangement according to claim 1, characterized by a second part-cylindrical surface (19) which is curved in a direction opposite to the first part-cylindrical surface (18) and which adjoins said first part-cylindrical surface at the inlet end thereof remote from the counter cutting-bit (17).

* * * * *